United States Patent [19]

Oberdorf

[11] Patent Number: 4,508,207

[45] Date of Patent: Apr. 2, 1985

[54] CIGARETTE HANDLING APPARATUSES

[75] Inventor: Manfred Oberdorf, Gevelsberg, Fed. Rep. of Germany

[73] Assignee: Maschinenfabrik Alfred Schmermund GmbH & Co., Gevelsberg, Fed. Rep. of Germany

[21] Appl. No.: 209,358

[22] Filed: Nov. 24, 1980

Related U.S. Application Data

[63] Continuation of Ser. No. 962,257, Nov. 20, 1978, abandoned.

[30] Foreign Application Priority Data

Nov. 19, 1977 [DE] Fed. Rep. of Germany ..... 2751760

[51] Int. Cl.[3] ..... B65G 29/00

[52] U.S. Cl. ..... 198/478; 198/457; 198/689

[58] Field of Search ..... 198/441, 450, 456, 457, 198/478, 480, 689, 792

[56] References Cited

U.S. PATENT DOCUMENTS

| | | | |
|---|---|---|---|
| 3,554,362 | 1/1971 | Salkeld | 198/478 |
| 3,863,750 | 2/1975 | Giatti | 198/689 |
| 3,952,865 | 4/1976 | Rudszinat et al. | 198/689 |

FOREIGN PATENT DOCUMENTS

| | | | |
|---|---|---|---|
| 2007615 | 9/1971 | Fed. Rep. of Germany | 198/480 |

*Primary Examiner*—Joseph E. Valenza

*Attorney, Agent, or Firm*—Sughrue, Mion, Zinn, Macpeak and Seas

[57] ABSTRACT

There is disclosed cigarette handling apparatus for transferring cigarettes from a first stream, in which they move at a first speed one after the other in a feed direction parallel to their axes, to a second stream, in which they move at a second speed one after the other in an outflow direction at right angles to their axes. A transfer drum is mounted to be rotatable about an axis parallel to the feed direction and a plurality of cigarette carrier elements are slidably mounted around the drum for reciprocation parallel to this axis. Each carrier element is movable by the drum between a first position for lateral entrainment by suction of a cigarette from the first stream and a second position for delivery of the entrained cigarette to the second stream. A cam is arranged to cause each carrier element to execute a reciprocation in each drum revolution. The configuration of the cam provide is such that, during rotation of the drum, each carrier element when at the first position is displaced along the drum parallel to the feed direction at a speed at least equal to the first speed. This displacement of the carrier element is thereafter so progressively decelerated as to have ceased when the element is at the second position. As a result, transfer of cigarettes from the first to the second stream takes place with controlled deceleration of the speed of each cigarette in its axial direction.

9 Claims, 5 Drawing Figures

CIGARETTE HANDLING APPARATUSES

This is a continuation of application Ser. No. 962,257, filed Nov. 20, 1978, now abandoned.

BACKGROUND OF THE INVENTION

The present invention relates to a cigarette handling apparatus.

As is known, cigaretts coming for example from a cutting device of a cigarette stranding machine are initially conveyed forward in the direction of their axes and then must be subsequently conveyed transversely to their axes as a single-rowed or double-rowed transverse axial stream.

Apparatus are known for the depositing of cigarettes, in which the cigarettes are accelerated in their axial direction by one or more segment wheels, and individually conveyed into grooves of a deposit drum, where they are braked and positioned by abutments.

With the presently customary high production speeds, however, the cigarette ends may however become damaged by, and/or may bounce back from the abutments, and their positioning thereby becomes inaccurate. Apparatus have therefore been developed, in which the cigarettes, after entry into the grooves of the deposit drum, are braked by friction, for example, by sucking them against the groove base. Such an apparatus is described in DT-OS No. 17 61 788. A problem with this apparatus is that the friction is not exactly constant and also the underpressure is not exactly controllable, such that a cigarette can, in spite of the braking effect, still bounce against and be the abutment, and can also bounce back, while another cigarette comes to a standstill before the abutment. Additional apparatus must thus be used to bring the cigarettes into the correct position after the braking and to hold them in position. This appreciably increases the driving effort required, and there is still the danger of the cigarette ends becoming damaged.

Since these apparatus are unsatisfactory, other apparatus have been developed which grip the cigarettes individually or in pairs by mechanical means with the aid of suction, and then convey them on circular, elliptical or cycloidal paths and transfer them to a drum. Such apparatus are described for example in DT-PS No. 23 37 945, DT-OS No. 19 52 508 and DL-PS No. 116 748. These apparatus are, however, mechanically very complex, require maintenance and are expensive. Also, the tolerances brought about by natural wear of a large number of joints and bearing locations in such apparatus result in a rapid loss of accurate operation of the apparatus.

It is an object of the present invention to provide an apparatus which has the advantage of the gripper mechanisms, namely their positioning accuracy, but in which the mentioned disadvantages, namely the longitudinal axial loading of the cigarettes on the one hand, or the constructional complications on the other hand, are avoided.

SUMMARY OF THE INVENTION

According to the present invention there is provided a cigarette handling apparatus for transferring cigarettes from a first stream, in which said cigarettes are conveyed at a first speed one behind another in a direction substantially parallel to their axes, into a second stream, in which in said cigarettes are conveyed at a second speed one behind another and in a direction substantially at right angles to their axes. The apparatus comprises rotatable drum means, and a plurality of cigarette carrier elements provided on said drum each receiving at a first position thereof at least one of said cigarettes from said first stream and each rotatably carrying the cigarettes to a second position thereof. The apparatus further includes cam means having a cam profile disposed to engage said carrier elements, wherein said cam profile is of such a configuration that, when in operation, said carrier elements are rotated at a speed co-ordinated with said first speed, said carrier elements being each displaced at said first position thereof by said cam means in a direction which is substantially parallel to said conveying direction of said first stream and at a speed which is approximately equal to said first speed. The apparatus is designed such that said cigarettes are delivered from each carrier element at said position thereof at a speed which in the axial direction of said cigarettes is at least substantially less than said first speed.

The drum may be rotatable about an axis substantially paralle to said conveying direction of said first stream, and the carrier elements are each displaceable by said cam means in a direction which is substantially parallel to said axis. The apparatus is so arranged in operation that each carrier element rotates at a constant speed.

The drum may comprise elements disposed at the periphery of a notional cylinder and may have its axis of rotation oblique to said conveying direction of said first stream.

The drum may comprise elements disposed at the periphery of a notional frusto-cone and said carrier elements may each be displaceable in a direction parallel to the axis of said cone.

The drum may be formed as a disc member and said carrier elements may each be radially displaceable.

The cam means may have a circular cross-section in a plane perpendicular to said axis of the drum, and each carrier element may be provided with a roller cam follower which is resiliently biased against said cam profile.

In operation, said carrier elements at said second position thereof may have a speed in the axial direction of said cigarettes which is zero, and the carrier elements at said first position thereof may have a speed in the axial direction of said cigarettes which is greater than said first speed of said cigarettes.

The carrier elements may each comprise plastics material and are each slidably supported on guide means.

The drum may be drivably connected to a machine arranged to issue said first stream.

Each carrier element may be provided with a trough having a size and shape adapted to the diameter of said cigarettes, and each such trough may be provided with at least one bore which in operation is connected to a source of vacuum when said respective carrier element is at said first position thereof and which communicates with the atmosphere when said respective carrier element is at said second position thereof.

Said at least one bore may be connected to said source of vacuum through said slidable guide means.

BRIEF DESCRIPTION OF THE DRAWINGS

Embodiments of the present invention will now be more particularly described by way of example and with reference to the accompanying drawings in which.

DESCRIPTION OF PREFERRED EMBODIMENTS

Figure 1:
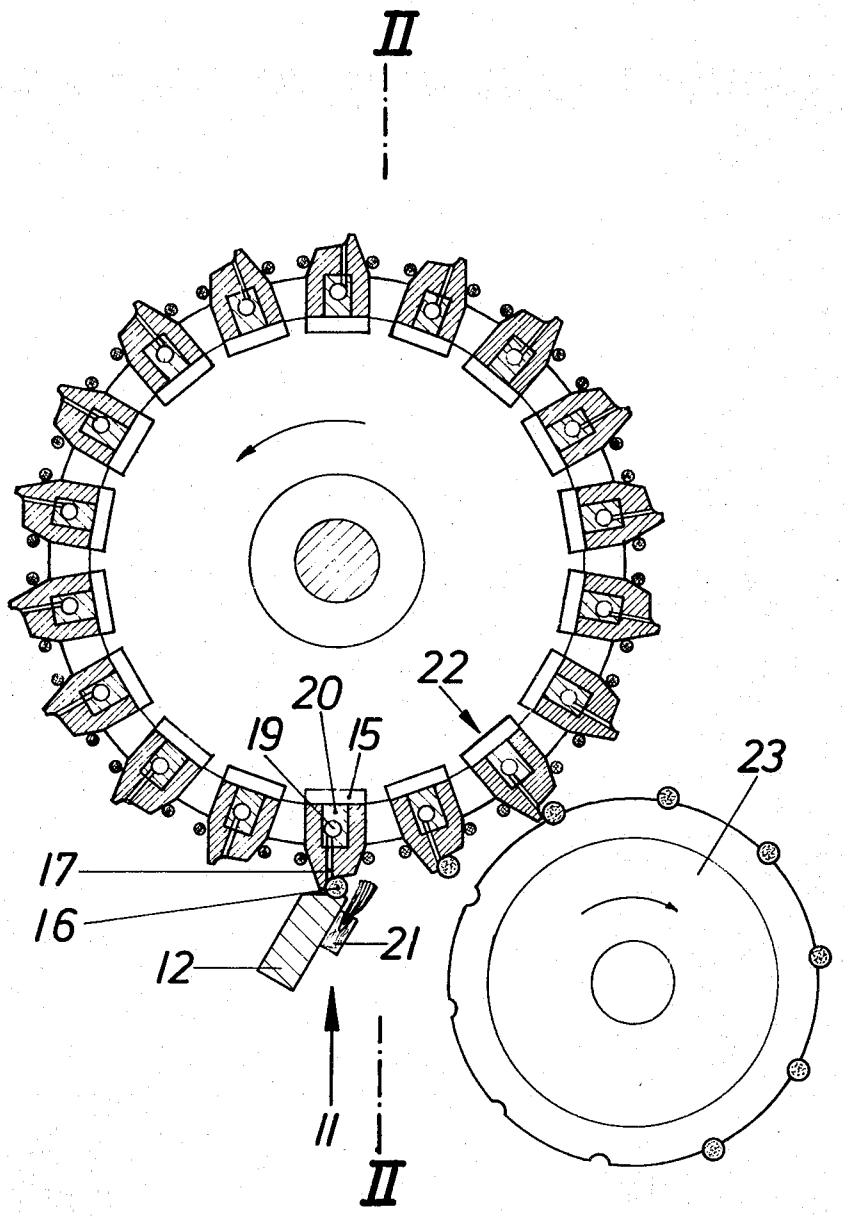
FIG. 1 shows a section through an apparatus embodying the invention taken along line I—I of the FIG. 2. but with the cam omitted.

A drum 1 is connected through a bearing body 2 with a frame 3, and is provided with sliding guides 4, on which elements 5 are arranged to be displaceable parallel to the axis of the drum 1. These elements 5 are made of a self-lubricating synthetic material so as to prevent pollution of the cigarettes. Clamped around the elements 5 and around a counter-holder 6 is a respective ring 7 of resilient material, for example rubber, which urges the respective element 5 via a roller 8 against a control cam 9. Upon rotation of the drum 1, the elements thus run through a path 10 (FIG. 3) determined by the control cam 9. At a location 11, the speed of a cigarette stream 14 conveyed forward on a rail 12 in the direction of an arrow 13 is just exceeded by the elements 5. At the same instant, one of the elements 5, designated by 15, comes into contact with a cigarette 16. Since bores 17 provided in a trough 18 of the element 15 are at this instant acted upon by suction air through a bore 19 of a sliding guide 20, the cigarette 16 is held fast on the element 15. A brush 21 prevents the possible bouncing-off of the cigarette 16 and thus permits the underpressure of the suction air to be no stronger than necessary for secure retention. Upon further rotation of the drum 1, the element moves to a location 22, where its speed component parallel to the cigarette stream 14 is zero, as can be seen from the profile of the path shown in FIG. 3. At this location, the cigarette 16 is transferred to further conveying equipment, for example a drum 23 (FIG. 1). Since the rotation of the drum 1 is synchronized with the cigarette stream 14 conveyed forward, it is driven by a machine (not shown) which delivers the stream 14, for example, a cigarette stranding machine.

The acceleration of the cigarettes in the transverse direction to the comparatively low peripheral speed of the drum is tolerated since the magnitude at this acceleration is small and does not hurt the cigarettes. The axial speed retardation of the cigarettes from the comparatively high speed of the conveyed stream 14, however, takes place in a controlled manner according to a law of motion optimally predetermined by the profile of the cam, so that the cigarettes are exposed to minimal loadings in the longitudinal direction.

Figure 2:
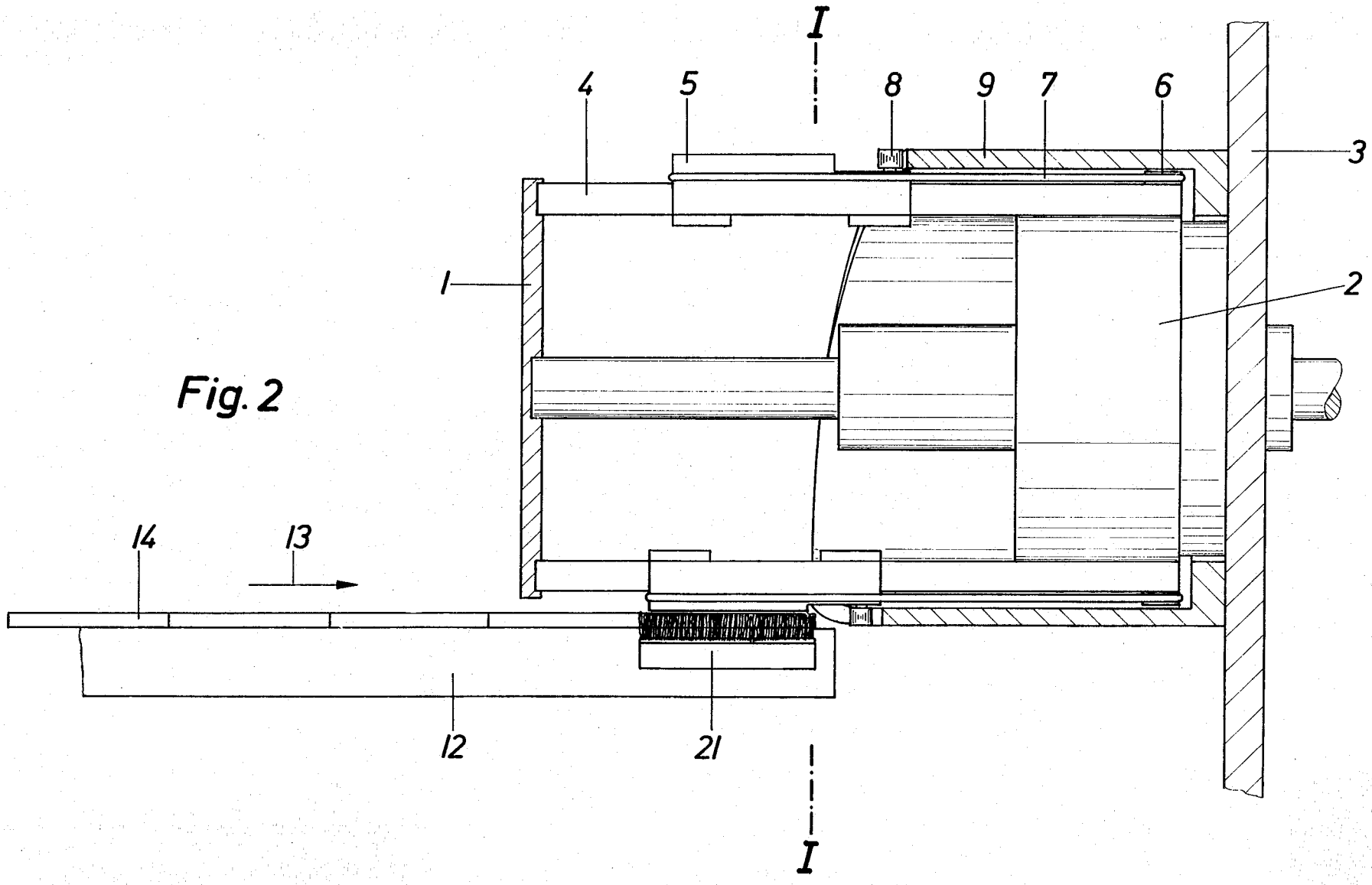
FIG. 2 shows a simplified section taken along line II—II in FIG. 1.
Figure 3:
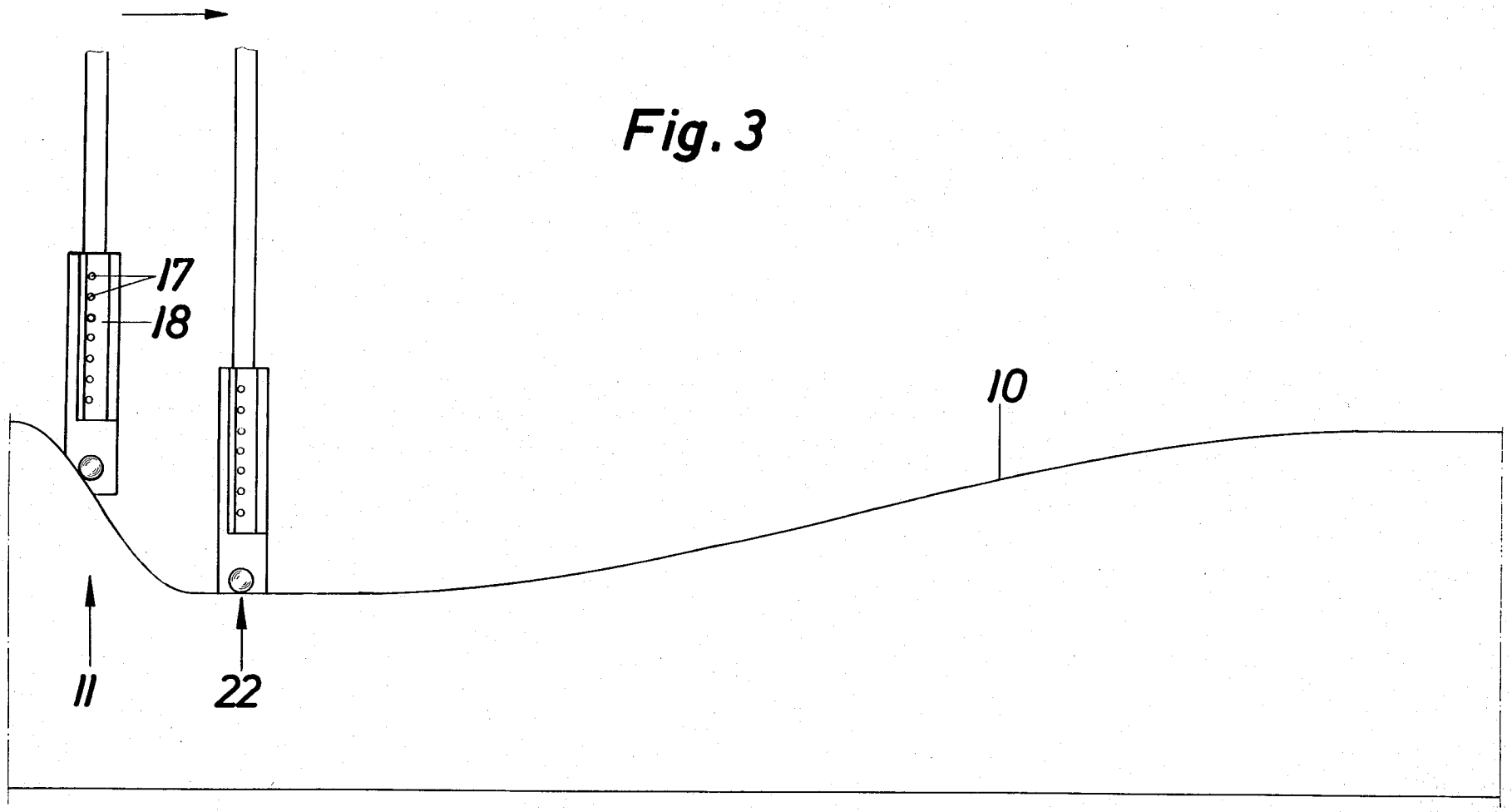
FIG. 3 shows a development of the cam with a respective element in the reception and delivery point.

In the embodiment described in relation to FIGS. 1 to 3, the second stream of cigarettes can be conveyed only at right angles to the first. If it is desired to convey the second stream not at right angles to the first, but obliquely or parallel to the first stream, this can be effected without the use of additional apparatus by setting the drum obliquely to the direction of the first stream. In this manner, the direction of the second stream departs from a right angle with respect to that of the first stream, according to the position of the withdrawal location, up to twice the angle at which the support 1 has been set obliquely to the direction of the first stream.

Figure 4:
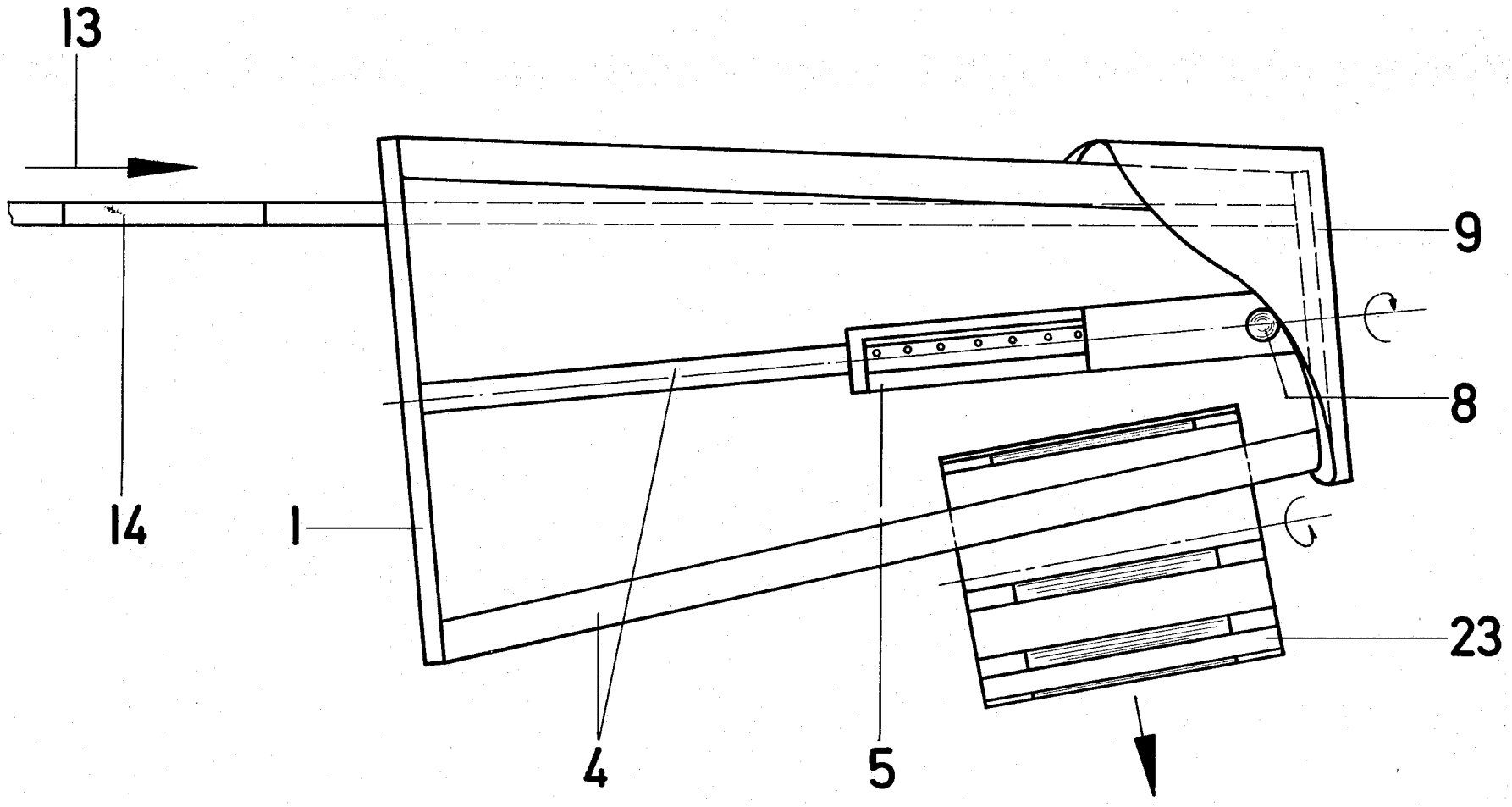
FIG. 4 shows another embodiment of the present invention with a conical frustum support.
Figure 5:
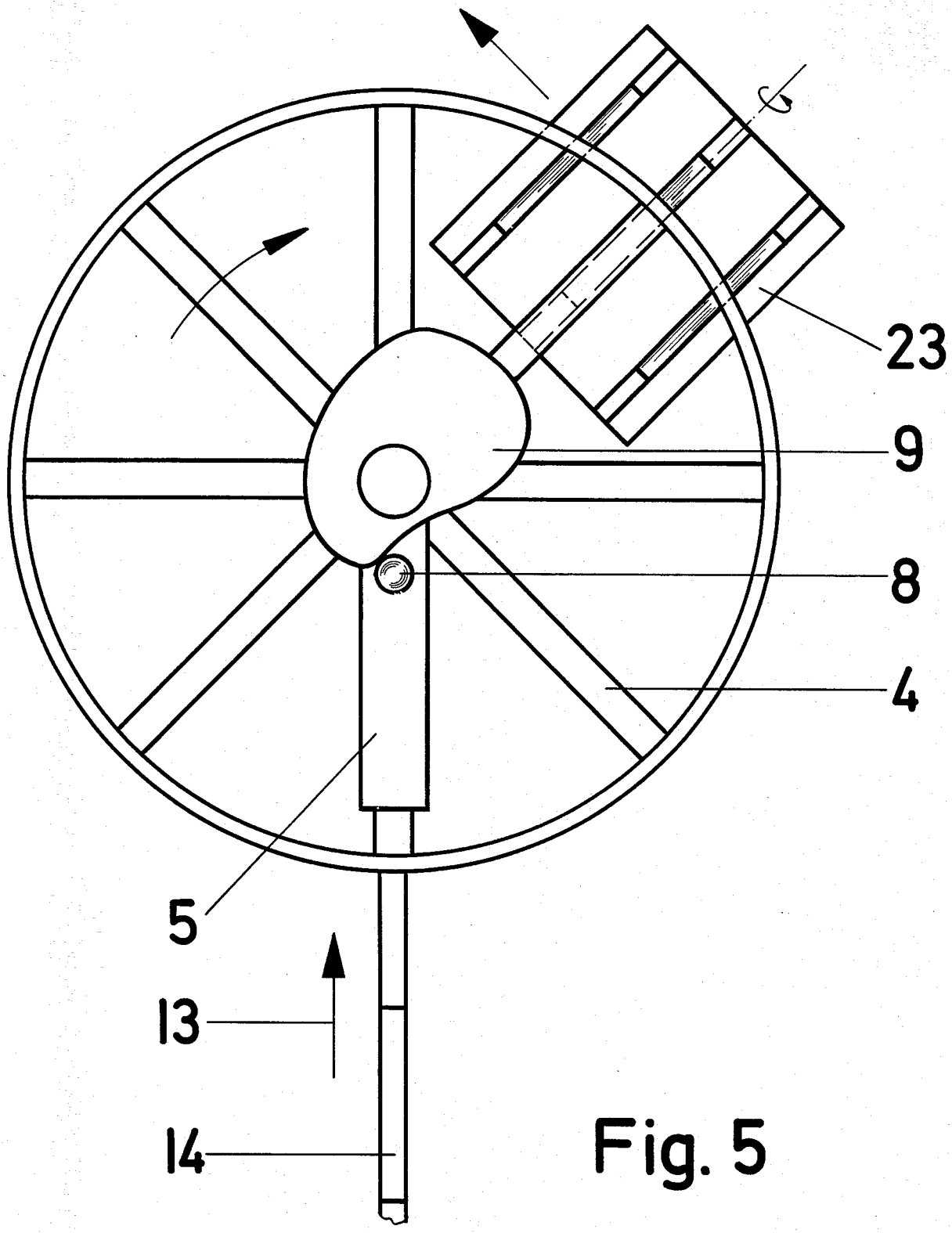
FIG. 5 shows another embodiment of the present invention with a disc shaped support.

Instead of setting the drum 1 obliquely, the drum 1 can be constructed in the shape of a conical frustum (FIG. 4), wherein the elements 5 are displaceable along the surface of the conical frustum in the direction of the axis of the conical frustum. In such an embodiment, either the large or the small diameter of the conical frustum can face the first stream, depending on whether the angle between the first and the second streams is obtuse or acute. The opening angle of the conical frustum can in that case be selected in accordance with the desired conveying direction. In the extreme case, by using a support in the form of a disc (FIG. 5) the angle can be 180°. The sliding guides are in this embodiment arranged in star-shape so that the elements 5 are radially displaceably on the disc-shaped support. With such an embodiment the direction of the second stream is selectable as desired solely through redisposition of the deposit location.

The apparatus described above by way of example can be manufactured very simply, has few movable parts and therefore is produceable at favourable costs as well as requiring little maintenance. Also it is unsusceptible to excessive wear in operation in the sense that the unavoidably arising wear of the movable parts only insubstantially impairs the precision of the conveying operation.

Although in the apparatus described above the cigarettes are singly conveyed further transverse-axially, they can be passed on in pairs with alight modification of the components of the apparatus.

We claim:

1. Cigarette handling apparatus for transferring cigarettes from a first stream, in which they move at a first speed one after the other in a first direction substantially parallel to their axes, to a second stream, in which they move at a second speed one after the other in a second direction substantially at right angles to their axes, the apparatus comprising a transfer drum mounted to be rotatable at a constant speed about an axis of rotation parallel to said first direction; a plurality of cigarette carrier elements each slidably mounted around the periphery of said drum for reciprocating movement parallel to said axis of rotation and each movable rotationally by the drum between a first position for lateral entrainment by suction of at least one cigarette from said first stream and a second position for delivery of said entrained cigarette to said second stream; roller cam follower means mounted on each of said carrier elements; and a cam mounted to be stationary relative to said drum and having means defining an endless cam track extending around the periphery of said drum intermediate the axial ends thereof; said cam track being so arranged as to impart to each said carrier element by way of said roller cam follower means one reciprocation parallel to said axis of rotation in each revolution of said drum and the configuration of said cam profile being such that during rotation of said drum at said constant speed each of said carrier elements, when at said first position, is slidably displaced along the drum in a direction parallel to said first direction and at a speed which is at least approximately equal to said first speed, and said slidable displacement of each carrier element being thereafter so progressively decelerated as to be at a speed substantially less than said first speed when the carrier element is at said second position, whereby said transfer of the cigarettes from said first stream to said second stream is carried out in such a manner that the speed of each cigarette in its axial direction is subject to progressive deceleration during the deceleration of said carrier elements.

2. Apparatus as defined in claim 1, comprising resilient means acting on said carrier elements in common to urge said roller cam follower means thereof against said cam track.

3. Apparatus as defined in claim 1, wherein each of said carrier elements when at said first position is slidably displaced at a speed which is greater than said first speed.

4. Apparatus as defined in claim 1, wherein said drum comprises a plurality of parallel guide members each defining a guide track for a respective one of the carrier elements.

5. Apparatus as defined in claim 4, wherein each of said carrier elements comprises plastics materials and extends at least partly around the respective guide member.

6. Apparatus as defined in claim 1, wherein said drum is drivably connected to a machine arranged to issue said first stream.

7. Apparatus as defined in claim 1, wherein each of said carrier elements is provided with a trough having a size and shape adapted to the diameter of said cigarettes.

8. Apparatus as defined in claim 7, wherein each of said troughs is provided with at least one bore which in operation is connected to a source of vacuum when the respective carrier element is at said first position and which communicates with the atmosphere when the respective carrier element is at said second position.

9. Apparatus as defined in claim 8, wherein said at least one bore is connected to said source of vacuum through guide means for the respective carrier element.

* * * * *